US006973771B2

(12) United States Patent
Nottin

(10) Patent No.: US 6,973,771 B2
(45) Date of Patent: Dec. 13, 2005

(54) DIFFUSER FOR TERRESTRIAL OR AVIATION GAS TURBINE

(75) Inventor: Claude Nottin, Saint Sauveur sur Ecole (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/347,446

(22) Filed: Jan. 21, 2003

(65) Prior Publication Data

US 2003/0136102 A1 Jul. 24, 2003

(30) Foreign Application Priority Data

Jan. 22, 2002 (FR) ..... 02 00764

(51) Int. Cl.[7] ..... F02G 1/00; F02C 3/04
(52) U.S. Cl. ..... 60/39.5; 60/805
(58) Field of Search ..... 60/39.5, 805, 804, 60/226.1, 264

(56) References Cited

U.S. PATENT DOCUMENTS 2,594,042 A 4/1952 Lee
4,098,073 A * 7/1978 Adkins et al. ..... 60/791
4,515,524 A * 5/1985 Fisher, Jr. ..... 415/169.1
5,916,127 A * 6/1999 Papamoschou ..... 60/226.1
6,574,965 B1 * 6/2003 Feulner ..... 60/785

FOREIGN PATENT DOCUMENTS

| | | |
|---|---|---|
| DE | 834 474 | 7/1949 |
| EP | 0 076 668 | 4/1983 |
| JP | 62-174507 | 7/1987 |

* cited by examiner

*Primary Examiner*—Charles G. Freay

(57) ABSTRACT

A diffuser for a gas turbine engine, said diffuser being disposed between a last stage of a turbine and an exhaust casing, and comprising an outer annular wall and an inner annular wall together defining an annular passage for fluid that diverges in the flow direction of said fluid, at least one of the annular walls including a plurality of orifices leading from said annular passage to at least one collecting box leading to means for exhausting a fraction of said fluid so as to reduce the flow speed of said fluid in said annular passage.

50 Claims, 2 Drawing Sheets

DIFFUSER FOR TERRESTRIAL OR AVIATION GAS TURBINE

BACKGROUND OF THE INVENTION

The present invention relates to the general field of diffusers for gas turbine engines of terrestrial or aviation type. It relates more particularly to diffusers placed between the turbine and the exhaust casing of a gas turbine engine.

The function of terrestrial or aviation gas turbines is to deliver power that is sufficient to drive either an alternator (terrestrial turbines) or a compressor (aviation turbines). To do this, a gas turbine takes a fraction of the energy of the hot compressed gases coming from the combustion chamber of the turbine engine and transforms it into mechanical energy. A turbine generally comprises a plurality of stages, each stage comprising a stator nozzle and a moving wheel placed after the nozzle for accelerating the flow of gas. The gas coming from the last stage of the turbine then feeds an exhaust casing.

The exhaust casing placed immediately downstream from the turbine is constituted by a diffuser and by casing arms which serve essentially to straighten the flow of gas at the outlet of a non-axial turbine and to pass cooling air for the internal portions of the engine. The diffuser serves to reduce the speed and increase the pressure of the gas coming from the last stage of the turbine. For this purpose, the diffuser generally comprises walls forming a passage for the gas, which walls diverge in the gas flow direction, as shown in U.S. Pat. No. 2,594,042.

An exhaust casing suffers from pressure losses which are typically proportional to the square of the speed of the gas at the leading edge of the casing arms. For example, for a terrestrial turbine, the gas reaches a speed close to Mach 0.6 at the outlet from the moving wheel of the last stage of the turbine. The diffuser enables this speed to be reduced to about Mach 0.45 at the leading edge of the casing arms, which leads to pressure losses of about 5%. Nevertheless, a gas speed of about Mach 0.45 still constitutes a value that is high. The slope of the walls constituting the diffuser must not exceed a certain value since otherwise there is a risk of boundary layers on said walls thickening. Thick boundary layers lead to separation, which harms the efficiency of the diffuser. Thus, when separation from the walls of the diffuser occurs, the aerodynamic section downstream therefrom is much smaller than its geometrical section, thus preventing the diffuser from performing its diffusion function. Furthermore, optimizing the turbine in terms of cost, mass, and performance generally leads to high loads per stage, giving rise to ever-increasing speed of the gas at the outlet from the last stage of the turbine.

OBJECT AND SUMMARY OF THE INVENTION

The present invention thus seeks to mitigate such drawbacks by proposing a gas turbine diffuser in which pressure losses are significantly reduced.

To this end, the invention provides a diffuser for a gas turbine engine, said diffuser being disposed between a last stage of a turbine and an exhaust casing, and comprising an outer annular wall and an inner annular wall together defining an annular passage for fluid that diverges in the flow direction of said fluid, wherein at least one of the annular walls includes a plurality of orifices leading from said annular passage to at least one collecting box leading to means for exhausting a fraction of said fluid so as to reduce the flow speed of said fluid in said annular passage.

As a result, the orifices made through at least one of the annular walls of the diffuser act via the collecting box to exhaust a fraction of the fluid passing through the annular passage, thus enabling the fluid flow speed in the annular passage to be reduced, and thus enabling pressure losses to be minimized. Any risk of boundary layers thickening on the walls of the diffuser and then separating is also eliminated. The collecting box(es) are also connected to at least one fluid exhaust channel. Advantageously, the diffuser further comprises suction means for controlling and monitoring a determined rate of flow for the fluid that is to be exhausted.

The orifices made through at least one of the annular walls may be holes or oblong slots that are substantially perpendicular to the wall or holes or oblong slots that are substantially inclined in the direction in which the fluid flows relative to the wall.

BRIEF DESCRIPTION OF THE DRAWINGS

Other characteristics and advantages of the present invention appear from the following description given with reference to the accompanying drawings which show an embodiment of the invention that has no limiting character. In the figures.

DETAILED DESCRIPTION OF AN EMBODIMENT

Figure 1A:
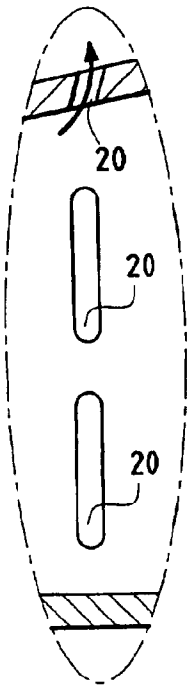
FIG. 1A is a fragmentary view of a second embodiment of a diffuser of the invention.
Figure 1:
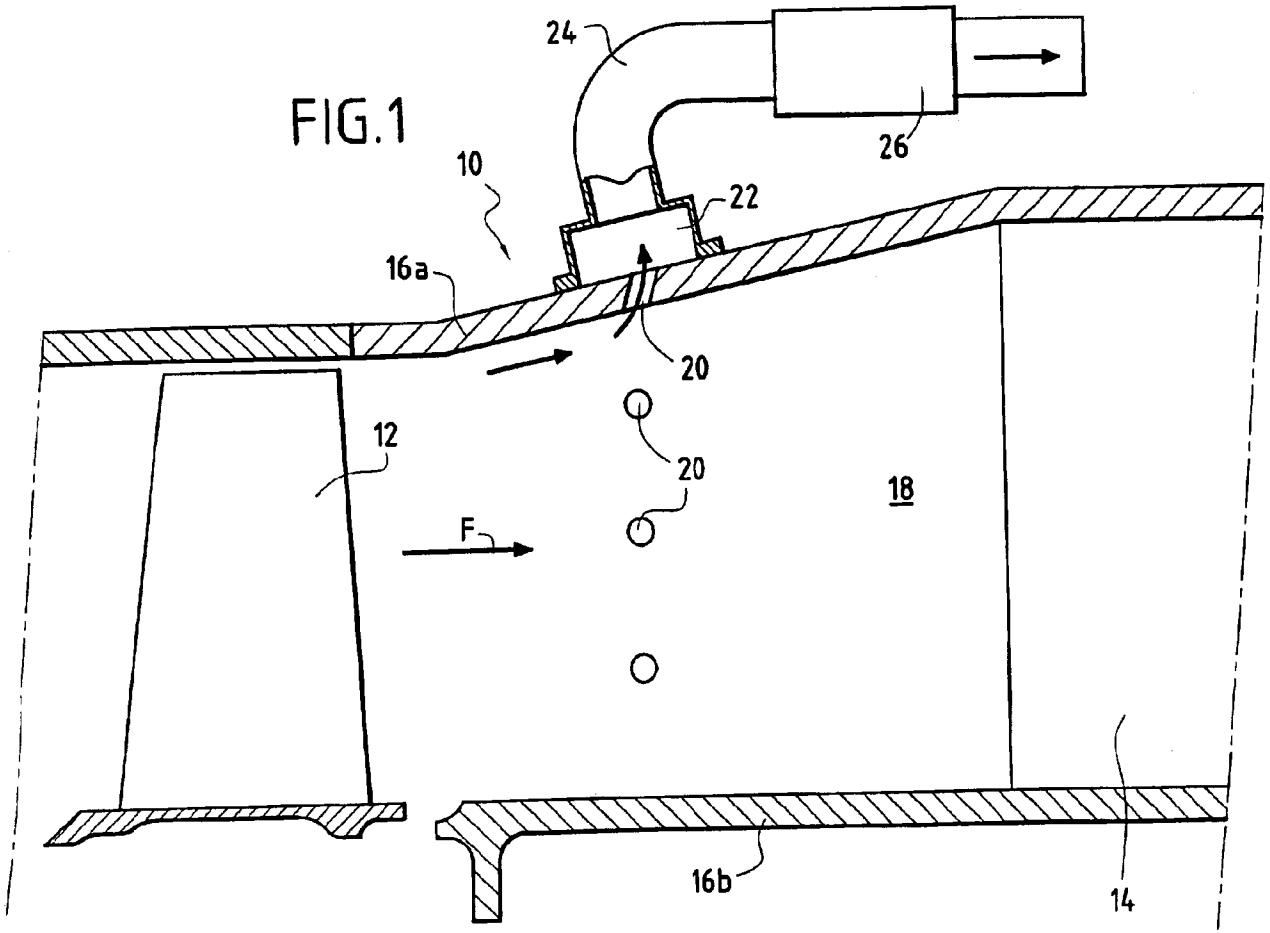
FIG. 1 is a longitudinal section view through a diffuser of the present invention.

In FIG. 1, there can be seen a diffuser 10 disposed immediately downstream from a moving wheel 12 of a last stage of a gas turbine, where "downstream" is in the flow direction of a gaseous fluid coming from said turbine and marked by arrow F. A casing arm 14 serving in particular to straighten the gas flow is mounted downstream from the diffuser 10.

The diffuser 10 has an outer annular wall 16*a* and an inner annular wall 16*b* so as to form an annular passage 18 for the gas from the turbine. The walls 16*a* and 16*b* are arranged in such a manner that the annular passage 18 diverges in the gas flow direction F so as to reduce the flow speed and increase the pressure of the gas passing therethrough. The outer wall 16*a* diverges while the inner wall 16*b* is substantially parallel to the axis (not shown) of the engine fitted with this diffuser. It is also possible to devise a diffuser in which the inner wall 16*b* diverges (relative to the fluid) while the outer wall 16*a* is parallel to the axis of the engine.

In the invention, the diffuser 10 has a plurality of orifices 20 through its outer annular wall 16*a* and/or its inner annular wall 16*b*, the orifices leading from the annular passage 18 to at least one collecting box 22 leading to means for exhausting a fraction of the gas passing through the annular passage.

Figure 2:
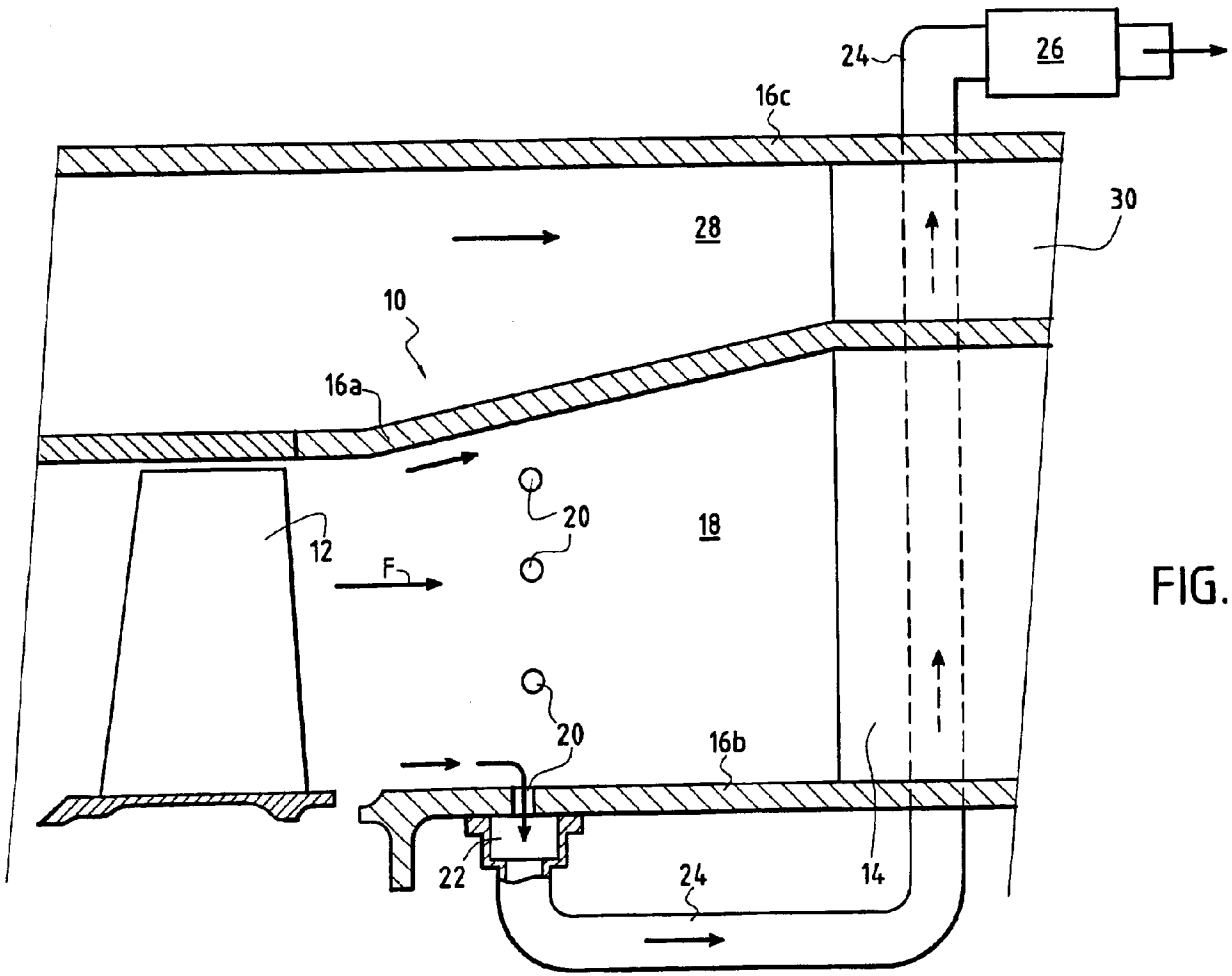
FIG. 2 is a longitudinal section view of a diffuser of the invention applied to a double-flow aviation gas turbine engine.

In FIG. 1, only the outer wall 16*a* is fitted with orifices 20. The orifices 20 shown are holes that are substantially inclined in the flow direction F of the gas relative to the outer wall 16*a*. It is also possible for the orifices 20 to be substantially perpendicular to the outer wall 16*a* and/or to the inner wall 16*b* (FIG. 2).

In a second variant shown in FIG. 1A, the orifices 20 may be in the form of a plurality of oblong slots extending over an angular sector of the outer wall 16*a*. These slots may likewise be substantially perpendicular or substantially inclined in the flow direction F of the gases relative to the outer wall 16*a*.

It yet another variant (not shown), the orifices 20 may be constituted by one or more slots of the "scoop" type having upstream and downstream walls that are radially offset. Chamfered slots of this type provide better guidance for the gas being directed towards the exhaust means.

A single annular box 22 may be provided for collecting the gas that is to be exhausted from all of the holes 20, or else a box, e.g. a cylindrical box, may be provided for each orifice 20 (or for a plurality of orifices) so as to ensure that the flow of gas to be exhausted is more uniform.

The gas collecting box or boxes 22 are preferably connected to at least one gas exhaust channel 24. One or more exhaust channels 24 may be provided per box 22. When the inner wall 16*b* of the diffuser is provided with orifices 20, the channel(s) 24 may pass along the casing arms 14 in order to exhaust the gases outside the diffuser.

According to an advantageous characteristic of the invention, the diffuser further comprises suction means 26 for sucking out the fraction of the gas that is to be exhausted. These suction means 26 may be constituted by a pilot valve, a pump, a compressor, or any other system enabling a desired flow of gas to be sucked out. Thus, it is possible to control and monitor a determined rate of flow of gas that is to be exhausted.

Nevertheless, if it turns out to be unnecessary to control the rate of flow of the gas for exhausting, then the gas passing through the orifices 20 formed in the outer wall 16*a* and/or the inner wall 16*b* may lead directly to the outside of the diffuser without passing via collecting boxes and evacuation channels for the gas. Under such circumstances, the pressure difference between the annular passage 18 and the outside of the diffuser suffices to suck out gas through the orifices 20.

FIG. 2 shows a diffuser of the invention applied to a double-flow aviation gas turbine engine. The diffuser 10 is disposed immediately downstream from a moving wheel 12 of a last stage of a gas turbine. The outer and inner walls 16*a* and 16*b* of the diffuser define a first diverging annular passage 18 for the gas coming from the turbine. This first passage 18 is commonly referred to as a "hot flow" passage. An additional wall 16*c* is placed coaxially around the walls 16*a* and 16*b* of the diffuser, thereby defining a second annular passage 28 for air sucked in by the fan (not shown) of the engine. This second passage 28 is referred to as being the "cold flow" passage.

In the invention, the inner wall 16*b* has a plurality of orifices 20 leading from the first annular passage 18 into at least one collecting box 22 connected to at least one gas exhaust channel 24. The exhaust channel(s) 24 pass along the casing arms 14 mounted in the first annular passage 18 and via casing arms 30 mounted in the second annular passage 28. The diffuser may also comprise suction means 26 for sucking out the fraction of gas that is to be exhausted.

What is claimed is:

1. A diffuser for a gas turbine engine, said diffuser being disposed between a last stage of a turbine and an exhaust casing, and comprising an outer annular wall and an inner annular wall together defining an annular passage for fluid that diverges in the flow direction of said fluid, wherein at least one of the annular walls includes a plurality of orifices leading from said annular passage directly to at least one collecting box leading to means for exhausting a fraction of said fluid so as to reduce the flow speed of said fluid in said annular passage.

2. A diffuser according to claim 1, wherein said plurality of orifices lead to a single annular collecting box for collecting the fraction of the fluid that is to be exhausted.

3. A diffuser according to claim 1, wherein at least one box is connected to at least one fluid exhaust channel.

4. A diffuser according to claim 3, wherein said at least one fluid exhaust channel passes via casing arms mounted in said annular passage defining a hot flow from the gas turbine engine and in a second annular passage defining a cold flow coaxial with said first-mentioned annular passage.

5. A diffuser according to claim 1, further comprising suction means for sucking out the fraction of fluid that is to be exhausted.

6. A diffuser according to claim 1, wherein said orifices are all substantially perpendicular to said annular wall.

7. A diffuser according to claim 1, wherein said orifices are all substantially inclined relative to said annular wall in the flow direction of said fluid.

8. A diffuser according to claim 1, wherein said orifices are oblong slots substantially perpendicular to said annular wall.

9. A diffuser according to claim 1, wherein said orifices are oblong slots substantially inclined relative to said annular wall in the flow direction of said fluid.

10. A diffuser according to claim 1, wherein said orifices are chamfered slots so as to improve guidance of the fraction of fluid that is to be exhausted towards said exhaust means.

11. A gas turbine engine comprising a diffuser according to claim 1, said diffuser being disposed between a last stage of a turbine and an exhaust casing.

12. A diffuser according to claim 1, wherein said at least one collecting box contacts said at least one of the annular walls around said openings so that said openings open directly into said at least one collecting box.

13. A diffuser for a gas turbine engine, said diffuser being disposed between a stage of a turbine and an exhaust casing, said diffuser comprising:

an outer wall and an inner wall together defining a first passage for a gas, wherein at least one of said outer and inner walls includes a plurality of orifices leading from said first passage;

casing arms mounted in said first passage defining a hot flow from the gas turbine engine and in a second passage defining a cold flow; and an exhaust channel along said casing arms and in communication with said first passage via said openings so as to exhaust a fraction of said gas from said first passage.

14. A diffuser according to claim 13, wherein said stage is a last stage of said turbine.

15. A diffuser according to claim 13, wherein said outer wall, said inner wall, said first passage, and said second passage are annular in shape.

16. A diffuser according to claim 13, wherein said first passage diverges in a flow direction of said gas.

17. A diffuser according to claim 13, wherein said second passage is coaxial with said first passage.

18. A diffuser according to claim 13, further comprising a box between at least one of said openings and said exhaust channel, said box being configured to collect gas exhausted from said first passage via said at least one of said openings.

19. A diffuser according to claim 18, wherein said box is in communication with each orifice of said plurality of orifices.

20. A diffuser according to claim 13, further comprising at least one box positioned between at least one of said openings and said exhaust channel, said box being configured to collect gas exhausted from said first passage via said at least one of said openings.

21. A diffuser according to claim 13, further comprising a system coupled to said exhaust channel and configured to suck out said fraction of gas.

22. A diffuser according to claim 13, wherein said orifices are substantially perpendicular to said at least one of said outer and inner walls.

23. A diffuser according to claim 13, wherein said orifices are substantially inclined relative to said at least one of said outer and inner walls in a flow direction of said gas.

24. A diffuser for a gas turbine engine, said diffuser being disposed between a stage of a turbine and an exhaust casing, said diffuser comprising:

an outer wall and an inner wall together defining a passage for a gas, wherein at least one of said outer and inner walls includes a plurality of oblong slots leading from said passage;

an exhaust channel in communication with said passage via said oblong slots so as to exhaust a fraction of said gas from said passage, and a single annual box between said oblong slots and said exhaust channel, wherein said single annular box is configured to collect gas exhausted from said passage via said oblong slots.

25. A diffuser according to claim 24, wherein said oblong slots are substantially perpendicular to said at least one of said outer and inner walls.

26. A diffuser according to claim 24, wherein said oblong slots are substantially inclined relative to said at least one of said outer and inner walls in a flow direction of said gas.

27. A diffuser according to claim 24, wherein said oblong slots are chamfered slots.

28. A diffuser according to claim 24, wherein said stage is a last stage of said turbine.

29. A diffuser according to claim 24, wherein said outer wall, said inner wall, and said passage are annular in shape.

30. A diffuser according to claim 24, wherein said passage diverges in a flow direction of said gas.

31. A diffuser according to claim 24, wherein said single annular box contacts said at least one of said outer and inner walls around said oblong slots so that said oblong slots open directly into said box.

32. A diffuser according to claim 31, wherein said box is in communication with each oblong slots of said plurality of oblong slots.

33. A diffuser according to claim 24, further comprising a plurality of boxes, each box being positioned between at least one of said oblong slots and said exhaust channel, said each box being configured to collect gas exhausted from said passage via said at least one of said oblong slots.

34. A diffuser according to claim 24, further comprising a system coupled to said exhaust channel and configured to suck out said fraction of gas.

35. A diffuser for a gas turbine engine, said diffuser being disposed between a last stage of a turbine and an exhaust casing, and comprising an outer annular wall and an inner annular wall together defining an annular passage for fluid that diverges in the flow direction of said fluid, wherein at least one of the annular walls includes a plurality of orifices leading from said annular passage to at least one collecting box leading to means for exhausting a fraction of said fluid so as to reduce the flow speed of said fluid in said annular passage, wherein said plurality of orifices lead to a single annular collecting box for collecting the fraction of the fluid that is to be exhausted.

36. A diffuser according to claims 35, further comprising suction means for sucking out the fraction of fluid that is to be exhausted.

37. A diffuser according to claim 35, wherein said orifices are all substantially perpendicular to said annular wall.

38. A diffuser according to claim 35, wherein said orifices are all substantially inclined relative to said annular wall in the flow direction of said fluid.

39. A diffuser according to claim 35, wherein said orifices are oblong slots substantially perpendicular to said annular wall.

40. A diffuser according to claim 35, wherein said orifices are oblong slots substantially inclined relative to said annular wall in the flow direction of said fluid.

41. A diffuser according to claim 35, wherein said orifices are chamfered slots so as to improve guidance of the fraction of fluid that is to be exhausted towards said exhaust means.

42. A gas turbine engine comprising a diffuser according to claim 35, said diffuser being disposed between a last stage of a turbine and an exhaust casing.

43. A diffuser for a gas turbine engine, said diffuser being disposed between a last stage of a turbine and an exhaust casing, and comprising an outer annular wall and an inner annular all together defining an annular passage for fluid that diverges in the flow direction of said fluid, wherein at least one of the annular walls includes a plurality of orifices leading from said annular passage to at least one collecting box leading to means for exhausting a fraction of said fluid so as to reduce the flow speed of said fluid in said annular passage, wherein at least one box is connected to at least one fluid exhaust channel, wherein said at least one fluid exhaust channel passes via casing arms mounted in said annular passage defining a hot flow from the gas turbine engine and in a second annular passage defining a cold flow coaxial with said first-mentioned annular passage.

44. A diffuser according to claims 43, further comprising suction means for sucking out the fraction of fluid that is to be exhausted.

45. A diffuser according to claim 43, wherein said orifices are all substantially perpendicular to said annular wall.

46. A diffuser according to claim 43, wherein said orifices are all substantially inclined relative to said annular wall in the flow direction of said fluid.

47. A diffuser according to claim 43, wherein said orifices are oblong slots substantially perpendicular to said annular wall.

48. A diffuser according to claim 43, wherein said orifices are oblong slots substantially inclined relative to said annular wall in the flow direction of said fluid.

49. A diffuser according to claim 43, wherein said orifices are chamfered slots so as to improve guidance of the fraction of fluid that is to be exhausted towards said exhaust means.

50. A gas turbine engine comprising a diffuser according to claim 43, said diffuser being disposed between a last stage of a turbine and an exhaust casing.

* * * * *